US005100027A

United States Patent [19]

Guéret

[11] Patent Number: 5,100,027

[45] Date of Patent: Mar. 31, 1992

[54] DISPENSING UNIT FOR AT LEAST ONE PRODUCT, A COSMETIC PRODUCT IN PARTICULAR, IN CREAM, LIQUID OR POWDER FORM

[75] Inventor: Jean-Louis Guéret, Paris, France

[73] Assignee: L'Oreal, Paris, France

[21] Appl. No.: 556,072

[22] Filed: Jul. 23, 1990

[51] Int. Cl.[5] ..... B67D 5/00

[52] U.S. Cl. ..... 222/105; 222/260; 222/321; 222/380; 222/383; 222/387

[58] Field of Search ..... 222/105, 321, 380, 383, 222/387, 386.5, 494, 260

[56] References Cited

U.S. PATENT DOCUMENTS

| | | | |
|---|---|---|---|
| 3,187,960 | 6/1965 | Gorman | 222/380 |
| 3,507,586 | 4/1970 | Gronemeyer et al. | 222/321 |
| 3,820,689 | 6/1974 | Cocita | 222/207 |
| 4,050,613 | 9/1977 | Corsette | 222/321 |
| 4,084,731 | 4/1978 | Ayres | 222/380 |
| 4,099,651 | 7/1978 | Winckelmann | 222/94 |
| 4,124,150 | 11/1978 | Moss | 222/494 |
| 4,394,939 | 7/1983 | Thor et al. | 222/494 X |
| 4,457,454 | 7/1984 | Meshberg | 222/321 X |
| 4,511,068 | 4/1985 | Bossing | 222/387 X |
| 4,696,415 | 9/1987 | Meshberg | 222/383 X |
| 4,705,195 | 11/1987 | Heck | 222/383 X |
| 4,795,063 | 1/1989 | Sekiguchi et al. | 222/105 |
| 4,872,596 | 10/1989 | Corsette | 222/380 |
| 4,875,604 | 10/1989 | Czech | 222/321 X |
| 4,892,228 | 1/1990 | Yano | 222/380 X |
| 4,903,868 | 2/1990 | Ichihara et al. | 222/383 X |
| 4,936,493 | 6/1990 | Foster et al. | 222/494 X |
| 4,978,036 | 12/1990 | Burd | 222/494 X |

FOREIGN PATENT DOCUMENTS

| | | | |
|---|---|---|---|
| 8800911 | 2/1988 | Japan | 222/386.5 |
| 9005091 | 5/1990 | PCT Int'l Appl. | 222/321 |
| 083142A | 3/1982 | United Kingdom . | |

OTHER PUBLICATIONS

French Search Report dated Mar. 19, 1990—FR8910000.

*Primary Examiner*—Michael S. Huppert
*Assistant Examiner*—Anthoula Pomrening
*Attorney, Agent, or Firm*—Cushman, Darby & Cushman

[57] ABSTRACT

A unit for dispensing products in cream, liquid or powder form, comprising on a container (2) with a flexible bag or with a follower piston, a push button (8) forming a pump body sliding on a hollow piston (10) capable of being closed by a first valve (13), the outlet opening for the product in the push button (8) being provided with a second valve (25) that only opens in the dispensing direction of the product.

4 Claims, 3 Drawing Sheets

DISPENSING UNIT FOR AT LEAST ONE PRODUCT, A COSMETIC PRODUCT IN PARTICULAR, IN CREAM, LIQUID OR POWDER FORM

FIELD OF THE INVENTION

The present invention concerns a unit for dispensing at least one product, in particular a cosmetic product, in cream, liquid or powder form.

PRIOR ART

There are numerous dispensing units which comprise a container of the product to be dispensed whereon there is fixed a dispensing head in a detachable or non-detachable way. Depending on the number of products to be dispensed, the dispensing head may contain one or several ducts for dispensing the product.

When there are several products to be dispensed the container can, in the known way, comprise several portions which are either constituted by several independent receptacles or divided by internal partitions into compartments, each of the containers or compartments being connected to a duct of the same dispensing head.

The dispensing head may also contain a compartment for a product different from that in the container, this compartment being connected to the duct for dispensing the product contained in the container or to a different duct.

It is also known to use containers constituted by a tube or a flexible bag wherein a vacuum is gradually formed in the course of the dispensing, or containers containing a follower piston which rises progressively in the container towards the dispensing opening as the product is being dispensed, the dispensing head having no air inlet.

OBJECTS OF THE INVENTION

It is an object of the present invention to provide a dispensing head forming a self-priming pump without an air inlet, comprising on the one hand a tubular body carrying a first valve that is closed during the dispensing of the product and forms a piston, and on the other hand a push button that slides on the piston forming a pump body and is provided with a second valve opening under the pressure of the product to be dispensed.

It is also an object of the present invention to provide a unit for dispensing at least one product, in particular a cosmetic product, in cream, liquid or powder form, comprising on the one hand, a flexible container or one provided with a follower piston, and on the other hand a dispensing head comprising at least one outlet duct for the product to be dispensed and a push button for actuating the dispensing of the said product.

SUMMARY OF THE INVENTION

According the invention provides a unit for dispensing at least one product, in particular a cosmetic product, in cream, liquid or powder form, comprising on the one hand, a flexible container or one provided with a follower piston, and on the other hand a dispensing head comprising at least one outlet duct for the product to be dispensed and a push button for actuating the dispensing of the said product, wherein the dispensing head comprises a fixed tubular body communicating with the container and provided at its opposite end to the container with a first valve that only opens if there is a relative excess pressure on the container side, the push button of the said head forming a pump body wherein the tubular body constituting the piston of the pump slides in a leakproof manner, the push button containing at least one outlet duct for the product to be dispensed provided at its outlet opening with a second valve that only opens if there obtains a relative excess pressure inside the duct as compared to the outside, restoring means being disposed between a fixed part integral with the tubular body, and movable part integral with the push button.

The second valve may be any valve, opening only in the dispensing direction.

In one embodiment, the second vale is a cup valve constituted by two coaxial caps assembled by nesting, the first cap disposed on the container side being of a relatively rigid material and the second cap disposed towards the outside being of a resilient material, the two caps being provided with openings disposed in coaxial circles, the first cap comprising a first outwardly turned cylindrical skirt surrounding the set of openings of the first cap and the second cap comprising a second cylindrical skirt turned toward the container, surrounded by the openings of the second cap and being capable of being fitted into said first skirt so as to close the communication between the openings of the first and second caps when the product is not being dispensed, it being possible for the communication between the openings to be established by elastic deformation of the second cap under pressure from the product during the displacement of the push button towards the container, the second skirt returning to fit into the first skirt when the pressure of the product stops.

In another embodiment, the second valve is constituted by the closing system of a dispensing assembly disclosed in a U.S. patent application Ser. No. 07/556,546, filed July 24, 1990 and entitled "Dispensing Assembly for at least One Fluid Product, in particular Cosmetic or Pharmaceutical". Such a closing system is formed by an obturator which forms a part of the dispensing head of elastically deformable material, and by a seating which is another part of the dispensing head, the obturator (i) being in sealing contact with the associated seating while there is no dispensing, (ii) separating from said seating by elastic deformation under the pressure of the product to be dispensed and (iii) coming back into contact with the seating by elasticity, the obturator being subjected to the action of a constraint member having a tendency hold it applied against the seating with which is cooperates.

The elastically deformable material constituting the obturator is preferably a natural or synthetic elastomer. The elastomers which can be utilised include, for example, styrene-butadiene copolymers, nitrile rubbers, polychloroprene or neoprene, EPDM rubber, polyurethanes, silicone rubber and ethylene-vinylacetate copolymers. Advantageously the obturator is constituted by an elastically deformable lip forming part of a strip of elastically deformable material. The zone of contact between said lip and the seating may be constituted by a planar portion which has, for example, the form of a rectangle; the strip may slightly overlap the seating so as to form a spatula for the direct application of the product dispensed onto a surface, in particular on the skin in the case of a cosmetic product.

The seating may be either of rigid material or of elastically deformable material; in the latter case the part comprising the seating may be a second strip of elastic material, substantially parallel to the strip carrying the lip.

In the case where the obturator comprises a lip which forms part of a strip of elastically deformable material, the constraint member may be constituted by a rigid element maintaining said piece of elastically deformable material just at the edge of the lip; it may also cooperate with said piece of plastic material by a system of ribs/-grooves or by pushing with an appropriate surface against an excess thickness of the strip.

The first valve may be of any type since it only opens when there is a relative excess pressure on the container side. For example it may be a non-return valve which comprises either a pivoting flap or a ball.

Preferably the first valve is fixed to the seal arranged between the tubular body and the push button forming the body of the pump.

The biasing means outside the tubular body is preferably a compression spring.

Preferably, the tubular body is disposed on a plate, which may serve to secure the flexible bag or to close the container with a follower piston containing the product to be dispensed. This plate may carry a cylindrical wall coaxial with the tubular body and surrounding the latter. The biasing means abuts the free edge of this cylindrical wall.

Preferably, the push button comprises a cylindrical skirt sliding outside the tubular body and a cylindrical part sliding outside the cylindrical wall of the plate whereon the tubular body is disposed, the edges of the skirt and of the cylindrical part being joined by a flat surface against which the biasing means abuts. In a variant, the cylindrical skirt and the cap, which is adjacent to it, are moulded as a single piece.

The dispensing head is preferably covered by a protective cap during storage.

The inventive dispensing unit functions as follows:

The user depresses the push button sliding in the tubular body, the first valve coming to close the tubular body which may then act like a piston. The compressed product then causes the second valve to open and it is dispensed towards the outside while the push button is being moved. When the user stops exerting pressure on the push button, the biasing means returns the push button into the storage position and the second valve is closed; low pressure is created inside the push button which causes the first valve to open and some of the product contained in the container to be dispensed to be drawn up into the space constituted at least partly, by the push button forming the pump body.

BRIEF DESCRIPTION OF THE DRAWINGS

In order that the invention may more readily be understood two embodiments thereof, represented in the attached drawings, will now be described below on a purely illustrative and non-restrictive basis.

DETAILED DESCRIPTION OF THE PREFERRED EMBODIMENTS

Figure 1:
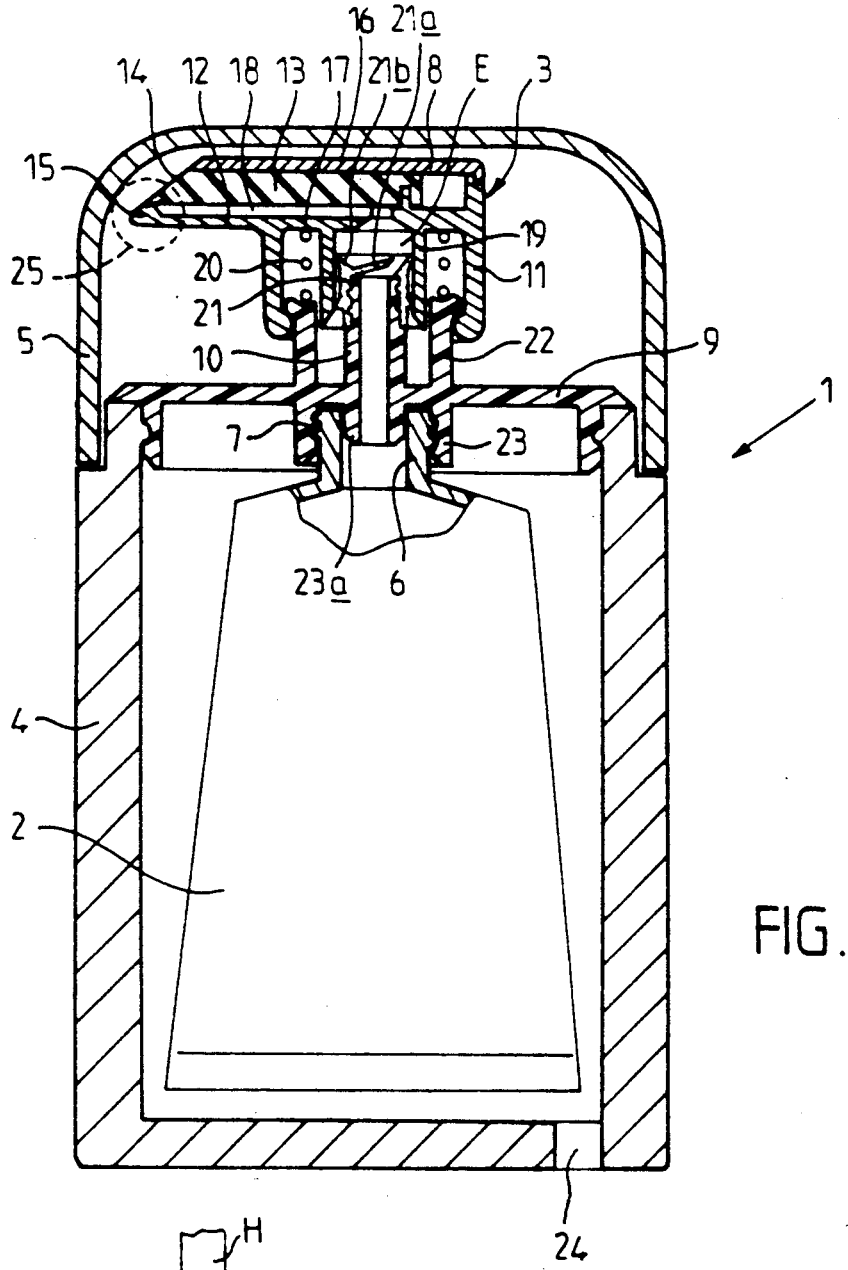
FIG. 1 is an axial section of a first embodiment of the dispensing unit according to the invention.

In the embodiment represented in FIG. 1, the dispensing unit is designated by 1. It comprises a flexible tube 2 whereon there is fixed a dispensing head designated by 3 as a whole. The flexible tube 2 is protected by a rigid shell 4 provided with a cap 5 that protects the dispensing head 3. The flexible tube 2 is provided with a neck 6 which has an external screw thread 7.

The dispensing head comprises a push button 8 and a plate 9 fixed to the edge of the rigid shell 4 carrying at its center a tubular body 10 forming a piston.

The push button 8 comprises a cylindrical part 11 provided, part way up, with a beak 12 forming a lateral extension the cylindrical part 11 is closed by a transverse wall 17 from which the beak 12 extends. On the transverse wall 17 rests an elastic strip 13 comprising a bevel whose end forms the lip 14. The edge of the beak 12 carried a rib 15 forming the seating. The lip 14 and the rib 15 of the beak constitute a valve 25 which only opens when the product is flowing in the dispensing direction. The elastic strip 13 is covered, except in the vicinity of the lip 14, by a rigid cover 16 forming a constraint member and fixed to the cylindrical part 11.

The beak 12 extends radially from the transverse wall 17 forming the top of the cylindrical part 11. The top comprises in its central zone an outlet opening for the product. This opening issues into a hollow duct 18 in the transverse wall 17 and in the beak 12. The duct 18 opens to the outside through an opening provided by the lip 14 and the bead 15.

The push button 8 comprises a skirt 19 coaxial with the cylindrical part 11 and situated radially inwardly thereof. A compression spring 20 is disposed in the annular space surrounding the skirt 19 and bears on the transverse wall 17.

The push button 8 is slidably mounted on the tubular body 10 provided at the center of the plate 9. The plate 9 is circular and is fixed by catch engagement to the edge of the rigid shell 4. Fixed on the upper edge of the tubular body 10 is a valve 21 comprising a pivoting flap 21*a* which is formed by molding integrally with a sleeve having one end which the flap can obturate. The sleeve surrounds the upper portion of the tubular body 10 so that the flap 21 can form a valve closing the end of the tubular body. The sleeve carried two sealing lips 21*b* on its outside bearing on the inner surface of the skirt 19. Thus, an internal space is defined between the flap 21*a* and the transverse wall 17 which space is reduced when the spring 20 is compressed.

A cylindrical wall 22 coaxial with the tubular body 10 and integral with the plate 9 surrounds the tubular body 10 over a fraction of its length. The spring 20 tends to move the push button away from the plate 9, the maximum separation being defined by the cooperation of two annular end beads respectively carried by the cylindrical part 11 and the cylindrical wall 22. The cylindrical wall 22 is extended on the opposite side to the plate 9 so as to form an internally threaded sleeve 23 into which the neck 6 of the flexible tube 2 may be screwed. An extension 23*a* of the tubular body 10 is arranged on the side of the plate 9 away from the tubular body. This extension is provided to enter with slight friction into the neck 6 of the tube 2 in order to ensure its centering. Provision is made for an air intake 24 in the bottom of the rigid steel.

The dispensing unit 1 functions as follows:

When the cap 5 has been removed, the user may compress the spring 20 by depressing the cover 16 of the push button 8, which produces a reduction of the space E, the compression of the product therein, the closing of the valve 21, and finally the emergence of the product contained in the duct 18 and in the internal space E of the push button 8 through the valve 25 formed by the lip 14 and the bead 15 of the beak 12. The tubular body 10 closed by the valve 21 has acted as a piston to ensure the dispensing.

When the user stops exerting any pressure on the push button 8, this spring 20 restores the push button 8 towards the high position in FIG. 1, which produces low pressure in the space E and produces the opening of the valve 21 and a transfer of the product between the tube 2 and the internal space E of the push button forming the pump body.

It will be seen that in this embodiment, the spring 20 is located outside the product during all the storage and dispensing stages, which avoids any contact with the dispensed product and therefore any pollution. Moreover, the dispensing head 3 forms a self-priming pump without any take-up of air, so the product to be dispensed is never in contact with air before being dispensed.

Figure 1A:
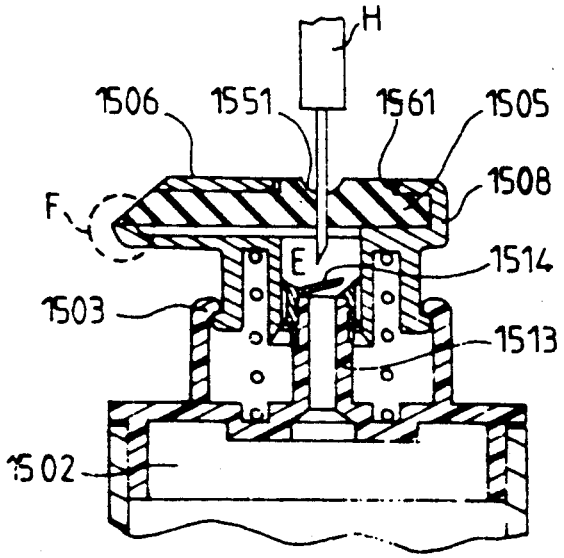
FIG. 1*a* is an axial cross-section of a variant of the dispensing head of this first embodiment.

FIG. 1*a* shows a dispensing head 1503 analogous to that shown in FIG. 1, which comprises a push button 1508 with a lateral exit, forming the pump body; this push button 1508 slides on a hollow piston 1513, carrying a flap valve 1514 so as to change the volume of the internal space E of the push button 1508. The rigid cover 1506 forms a constraint member; it is provided with an opening 1561 and, in the opening, the strip 1505 is narrowed at 1551. This arrangement permits the strip 1505 to be pierced in its narrowed zone 1551 by means of a Hypodermic needle; due to this arrangement, it is possible to expel the air contained in the space E and to suck the product from the container 1502. One may thus prime the pump system without contaminating the closing system F. One may equally introduce a purge gas.

Figure 1B:
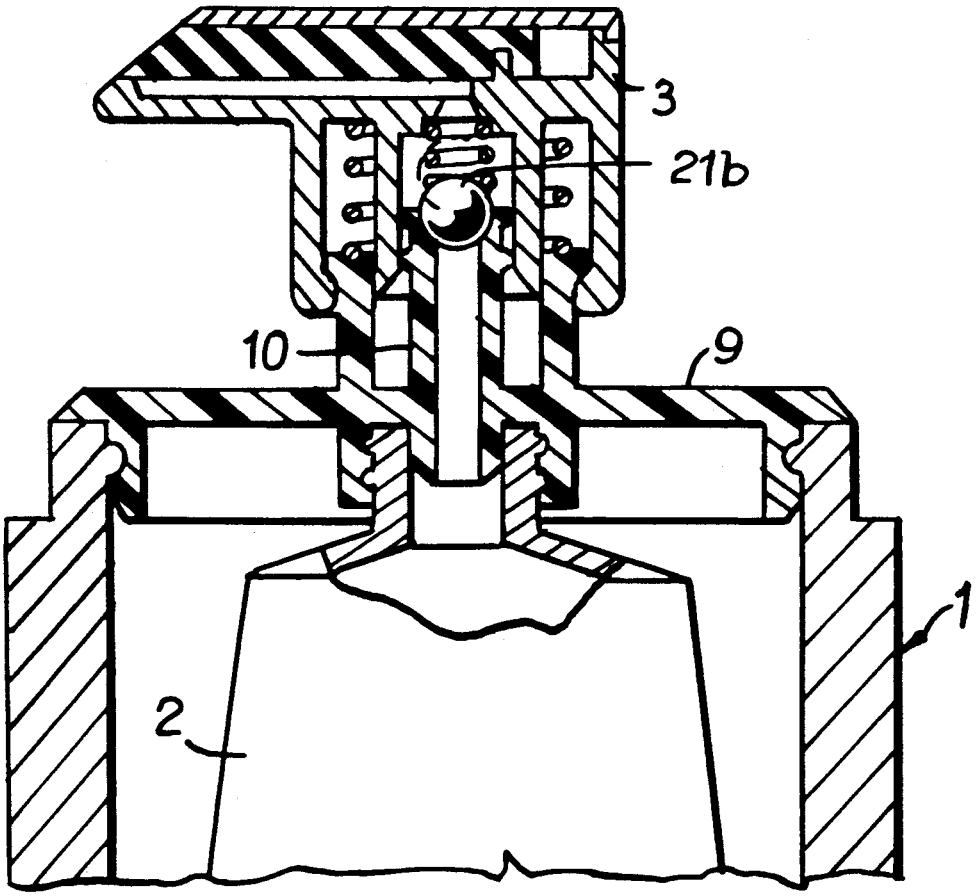
FIG. 1*b* is an axial section of another variant of the dispensing head of this first embodiment.

FIG. 1*b* is an illustration of the embodiment of FIG. 1 but showing a ball 21*b* as the valve member in place of the pivotable flap 21*a* of FIG. 1. In all other respects, the embodiment of FIG. 1*b* is identical to that of FIG. 1.

Figure 2:
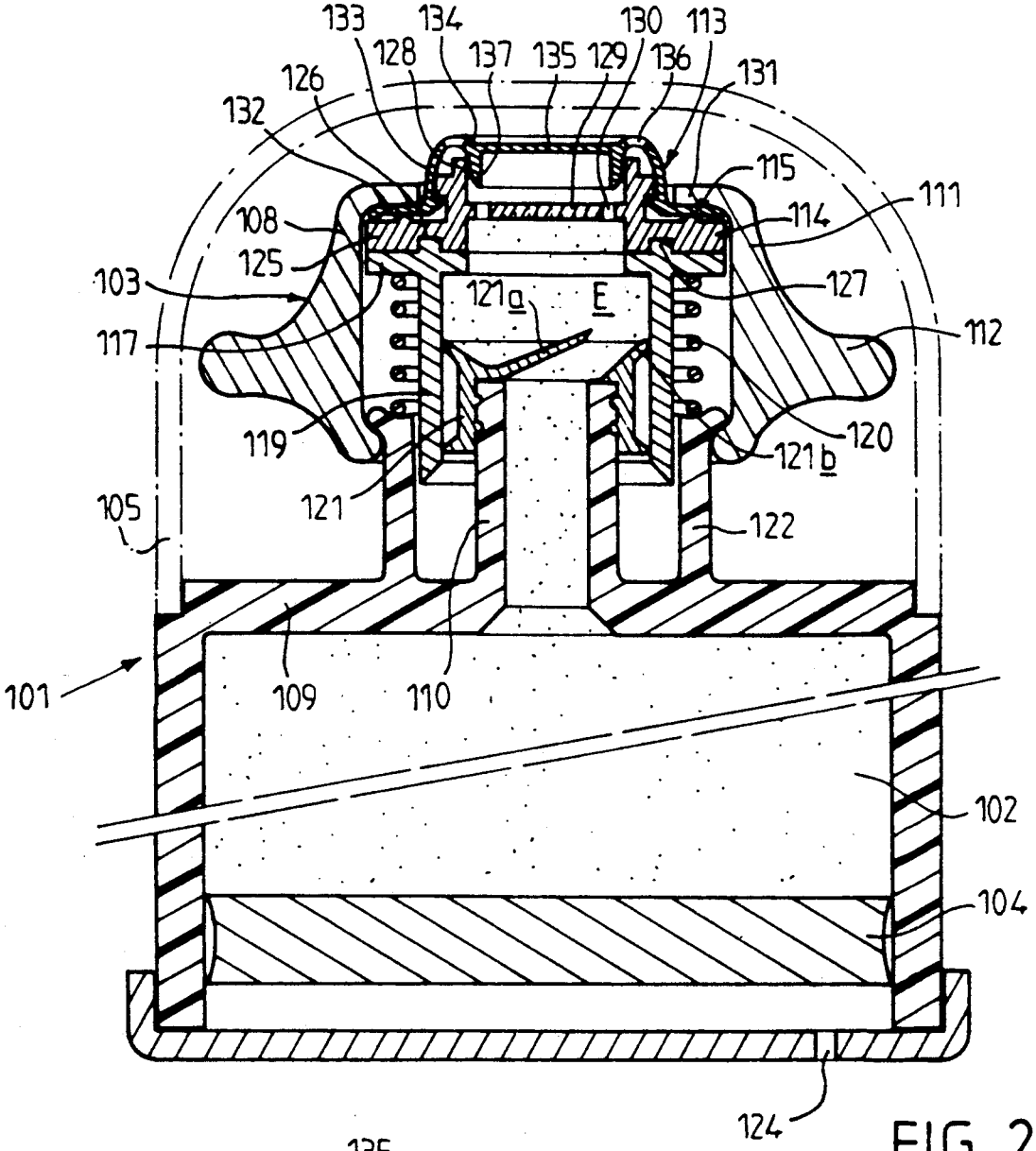
FIG. 2 is an axial section view of a second embodiment of the dispensing unit according to the invention.
Figure 3:
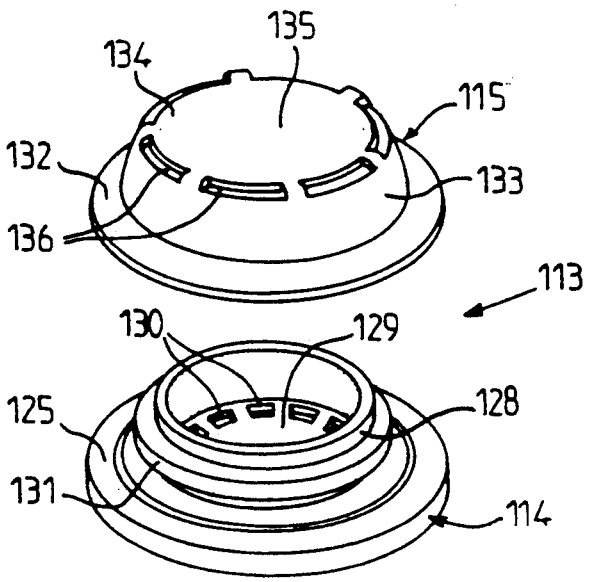
FIG. 3 is an exploded view in perspective of the second valve of the dispensing unit of FIG. 2.

FIG. 2 shows a second embodiment of the dispensing unit in accordance with the invention. This embodiment comprises as the second valve a cup valve to be described below. The dispensing unit is designated by 101 as a whole. It comprises a container 102 whereon there is fixed a dispensing head 103. The container 102 contains a follower piston 104 and its bottom is provided with an air intake opening 124. The dispensing head 103 may be protected by a cap 105 fixed by catch engagement on the container 102.

The dispensing head 103 consists of a movable push button 108 and a transverse plate 109 carrying a tubular body 110 forming a piston. The transverse plane 109 forms the upper side of the container, and it carried a cylindrical wall 122 surrounding the tubular body 110 over a portion of its length.

A first valve 121 comprising a pivoting flap 121*a* is fixed on the end of the tubular body 110 remote from the plate 109; this valve is integrally molded with a sleeve fixed on the end of the tubular body 110; its structure and mounting are the same as in the case of the valve 21. The sleeve is provided with sealing lips 121*b* bearing on the internal surface of the skirt 119.

The movable push button 108 comprises a cylindrical part 111 laterally provided with two radial extensions 112 serving as bearing surfaces for the fingers of the user. In its upper portion, the cylindrical part 111 comprises a transverse wall whose central zone is cut out and is surrounded by an annular flange 131. The second valve 113 of the dispensing head is positioned in the zone delimited by the flange 131 and is applied against the flange 131 by the annular washer 117 arranged at one of the ends of a cylindrical skirt 119. The relative centering of the valve 113 and the skirt 119 is ensured by a circular rib 127 provided on the washer 117 which cooperates with a groove 126 arranged on one of the parts of the valve 113. A helical spring 120 bears on the end bead of the cylindrical wall 122, and the bead cooperates with a complementary bead of the cylindrical part 111 for limiting the travel of the push button in the direction of the action exerted by the spring 120. The spring 120 is disposed in the annular space between the cylindrical part 111 and the skirt 119 and it bears on one side against washer 117 and on the other side against the end bead of the cylindrical wall 122. Thus the spring 120 maintains the valve 113 in bearing contact against the flange 131.

The valve 113 consists of two caps 114 and 115 nested one in the other, the lower cap 114 being made of a relatively rigid plastic material and the cap 115 being made of a flexible plastic material. The cap 114 comprises a first flange 125 provided on its side nearer the container with a circular groove 126. This flange 125 is joined to a cylindrical wall 128 containing a transverse disc 129 fixed to the internal surface of the said wall 128. The disc 129 is pierced by openings 130 disposed in a circle near the periphery of the disc 129. Provision is made from a wall 128 to facilitate the fixing by nesting of the second cap on the first cap. The cap 115 made of a flexible material comprises a circular flange 132 which bears on the circular flange 125 of the cap 114. A substantially conical surface 133 extends from the flange 132 and is closed by a pan 134 provided with a flat bottom 135. Openings 136 are arranged at the transition between the conical surface 133 and the pan portion 134. The flat bottom 135 of the pan 134 is provided over its periphery with a skirt 137 which is capable of being inserted with slight friction inside the cylindrical wall 128.

The device functions in the manner described below:

When the cap 105 has been removed, the user presses on the radial extensions 112 of the push button 108. The spring 120 is compressed. The cylindrical part 111 of the push button slides on the cylindrical wall 122, and the skirt 119 slides on the tubular body 110. Simultaneously, the valve 121 is closed. The tubular body 110 carrying the closed valve 121 acts like a piston and exerts pressure on the product contained in the volume E comprised between the valve 121, the skirt 119 and the valve 113. The product passes through the openings 130 of the rigid cap 114 and deforms the flexible 115 cap material by pushing in particular on the its disc 135. This deformation forms a passage between the skirt 137 of the cap 115 and the wall 128 of the cap 114. The product can then emerge through the openings 136 of the flexible cap 115.

When the user releases pressure on the push button 108, the biasing spring 120 returns the push button into the high position (see FIG. 2). The volume E increases and creates a pressure reduction. In the valve 113, the cap 115 returns into position on the cup 114, and closes the communication between the openings 130 and 136. The valve 121 opens, and a quantity of the product contained in the container 102 is drawn up into the volume E of the push button through the tubular body 110. Simultaneously, the follower piston rises towards the dispensing head in the container 102.

I claim:

1. In a unit for dispensing at least one product, in particular, a cosmetic product, in cream, liquid or powder form, comprising:

(a) a variable volume container means, (b) a dispensing head comprising at least one outlet duct for at least one product to be dispensed and a push button for actuating the dispensing of said at least one product, the improvement comprising said dispensing head including a fixed tubular body communicating with said container means and having an end remote from said container means, said end being provided with a first valve openable upon the existence of excess pressure on the side of said valve nearer said container means;

said push button of said dispensing head forming a pump body wherein the fixed tubular body forming a piston is slidable in a portion of said push button in a leak proof manner, said push button including said one outlet duct for the product to be dispensed, said outlet duct having an outlet opening provided with a second valve which opens upon the presence of an excess of pressure inside said outlet duct relative to the exterior pressure, and biasing means being provided between a portion of said fixed tubular body and a part of said push button, said second valve including a first portion made of elastically deformable material and a second portion which together with said first portion defines a section of said outlet duct, said section having one end in flow communication with said first valve and an opposite end closed by said second valve, said first portion being sufficiently flexible so as to move away from said second portion upon the pressure of the product accumulating in said outlet duct, said dispensing head including a constraint member tending to maintain said second valve in a closed position, said second valve comprising a lip on said second portion which is movable transversely away from said first portion to allow product to move therebetween when being dispensed.

2. A dispensing unit according to claim 1 wherein said first valve is a non-return valve comprising one of a pivoting flap valve and a ball valve.

3. A dispensing unit according to claim 1, wherein there is a seal between the tubular body forming the piston, and the push button forming the pump body; and wherein said first valve is integral with said seal.

4. A dispensing unit according to claim 1, wherein said unit includes a cap which is molded in a single piece with a cylindrical skirt which laterally delimits the pump body which constitutes the push button.

* * * * *